US005927241A

United States Patent [19]

Dahlberg et al.

[11] Patent Number: 5,927,241

[45] Date of Patent: Jul. 27, 1999

[54] CARBURETOR CONTROL FOR AN INTERNAL COMBUSTION ENGINE

[75] Inventors: Göran Dahlberg, Gränna; Gustaf Döragrip, Tenhult, both of Sweden

[73] Assignee: Aktiebolaget Electrolux, Stockholm, Sweden

[21] Appl. No.: 08/791,768

[22] Filed: Jan. 29, 1997

[30] Foreign Application Priority Data

Feb. 22, 1996 [SE] Sweden ..... 9600660

[51] Int. Cl.[6] ..... F02M 1/02

[52] U.S. Cl. ..... 123/179.5; 123/179.18; 261/52

[58] Field of Search ..... 123/179.5, 179.18, 123/179.16; 261/52

[56] References Cited

U.S. PATENT DOCUMENTS 4,079,708 3/1978 Wieland et al. ..... 123/179.18

FOREIGN PATENT DOCUMENTS 2105416 4/1972 France ..... 261/52

7602485 5/1983 Sweden .

*Primary Examiner*—Andrew M. Dolinar

*Attorney, Agent, or Firm*—Pearne, Gordon, McCoy & Granger LLP

[57] ABSTRACT

A carburetor control for a carburetor of an internal combustion engine is provided, in particular for a motor saw, in which the carburetor has a gas throttle (16) and a starting means (25) such as a choke valve. A gas control (11) is connected to the gas throttle, and a start control (20) is connected to the starting means and adjustable between a starting position and an operating position. The gas control (11) has a first stop (26) adapted to engage a corresponding stop (27) on the start control (20) in order to positively adjust the starting means (25) to the operating position, when the gas throttle (16) is opened.

6 Claims, 4 Drawing Sheets

28
29
23
12
24
25
16
14
13
31
20
22
21
27
26
32
11
17
19
18
10

CARBURETOR CONTROL FOR AN INTERNAL COMBUSTION ENGINE

BACKGROUND OF THE INVENTION

The present invention relates to a carburetor control for a carburetor of an internal combustion engine, in particular for a motor saw, said carburetor having a gas throttle and a starting means such as a choke valve, comprising a gas control connected to said gas throttle, and a start control connected to said starting means and adjustable between a starting position and an operating position.

SUMMARY OF THE INVENTION

It is an object of the invention to provide a carburetor control for preventing opening of the gas throttle when the starting means is in a starting position, and for preventing adjustment of the starting means to the starting position when the gas throttle is open.

Another object is to enable adjustment between starting and operating positions by means of one and the same control which, in addition, is preferably adjustable to a stop position for stopping the engine.

A further object is to prevent adjustment of the start control to a stop position when the gas throttle is open.

The above objects have been achieved by means of a carburetor control of the kind mentioned in the introduction which, according to the invention, is characterized in that the gas control has a first stop adapted to engage a corresponding stop on said start control in order to positively adjust said starting means to the operating position, when said gas throttle is opened.

BRIEF DESCRIPTION OF THE DRAWINGS

The invention will be described in more detail in the following with reference to the accompanying drawings, in which.

DETAILED DESCRIPTION OF THE PREFERRED EMBODIMENT

Figure 1:
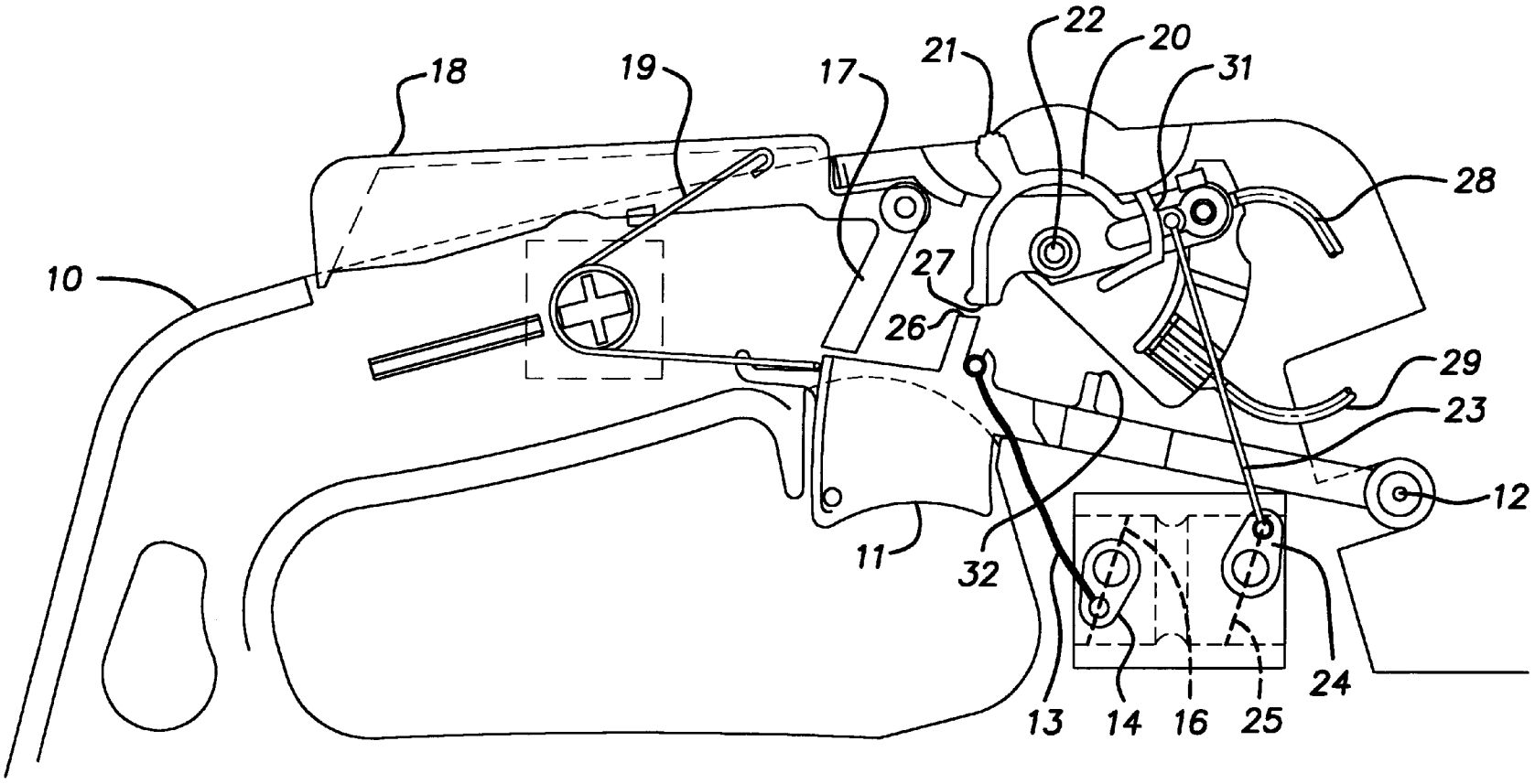
FIG. 1 illustrates a side elevation of the carburetor control according to the invention, in a starting position.

In the drawings, a handle 10 is shown forming part of a housing of a motor saw. The handle 10 is provided with a gas control 11 pivoted to a shaft 12 and connected by a wire 13 to a gas lever 14 of a carburetor 15 which is connected to an internal combustion engine (not shown). The gas lever 14 is connected to a gas throttle 16 shown in broken lines. In order to prevent unintentional opening of the gas throttle, the gas control cooperates in a conventional manner with a gas catch 17 actuatable by a catch handle 18. The gas control 11 and the catch handle 18 are actuated by a common return spring 19. A start control 20 is provided which is rotatable around a pivot 22 by means of a control lever 21. The start control 20 is connected by means of a bar 23 to a choke lever 24 which in turn is connected to a choke valve 25 shown in broken lines in the drawings.

In FIG. 1, the carburetor control is shown in a position for starting a cold engine, wherein the start control 20 is adjusted to its rear position and the choke valve 25 is closed. When the engine has started, the start control can be adjusted manually by the lever 21 to open the choke valve. As an alternative, the gas control can be actuated, after releasing the gas catch 17, so that a first stop 26 of the gas control engages a corresponding stop 27 on the start control which is thereby positively adjusted to open the choke valve. In FIG. 1, the wire 13 is shown slack, whereby, in spite of the gap shown between the stops 26 and 27, the gas throttle will not begin to open until the stops engage each other so that the choke valve opens simultaneously. It is thus not possible to open the gas throttle without opening the choke valve, too.

Figure 2:
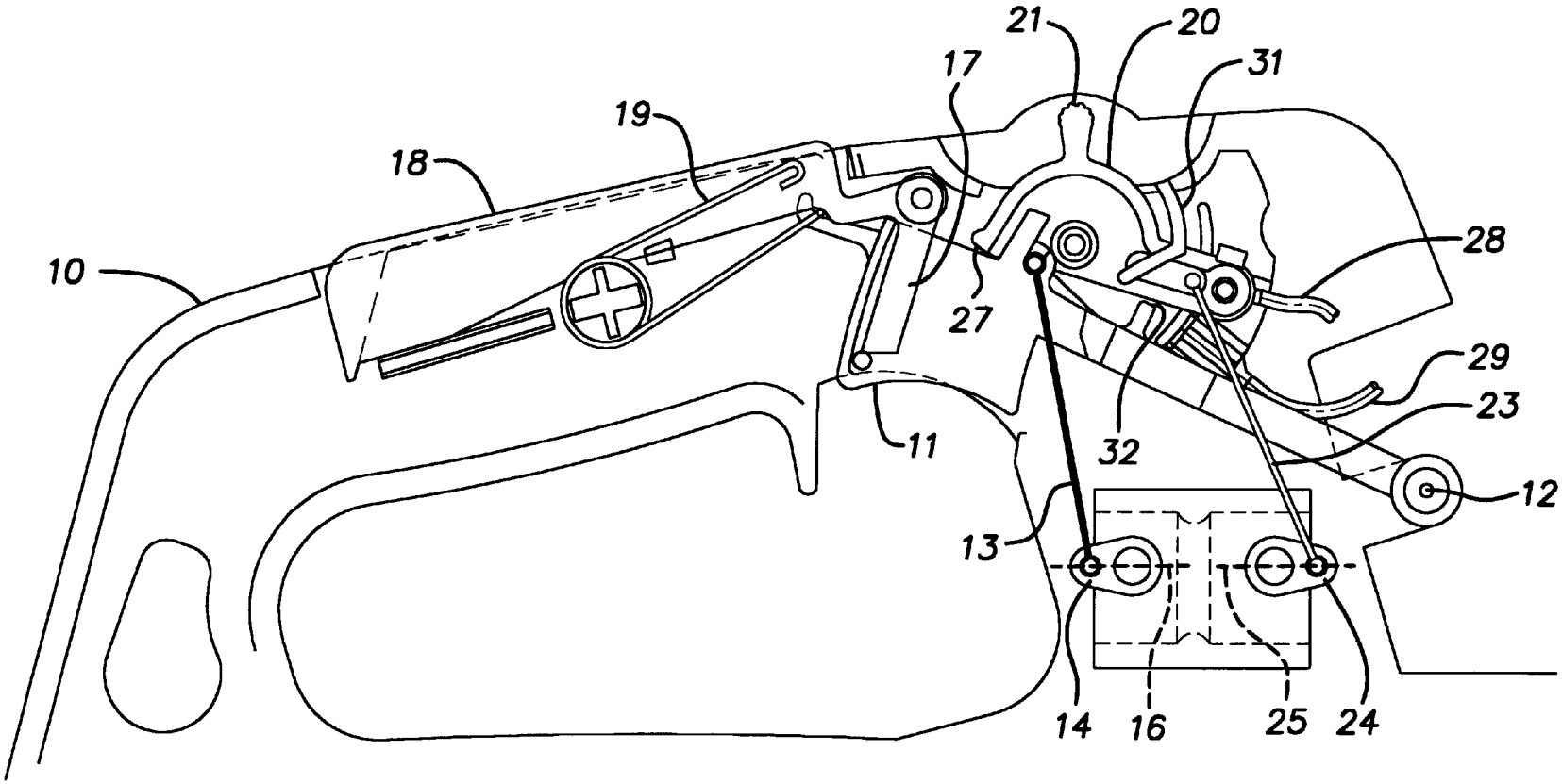
FIG. 2 is a corresponding view of the carburetor control in an operating position.

FIG. 2 shows an operating position in which the gas throttle is open. As can be seen in the Figure, in this position the choke control stop 27 engages the gas control which prevents adjustment of the choke control to a closed position. It is thereby ensured that the choke valve cannot be closed when the gas throttle is open.

Figure 3:
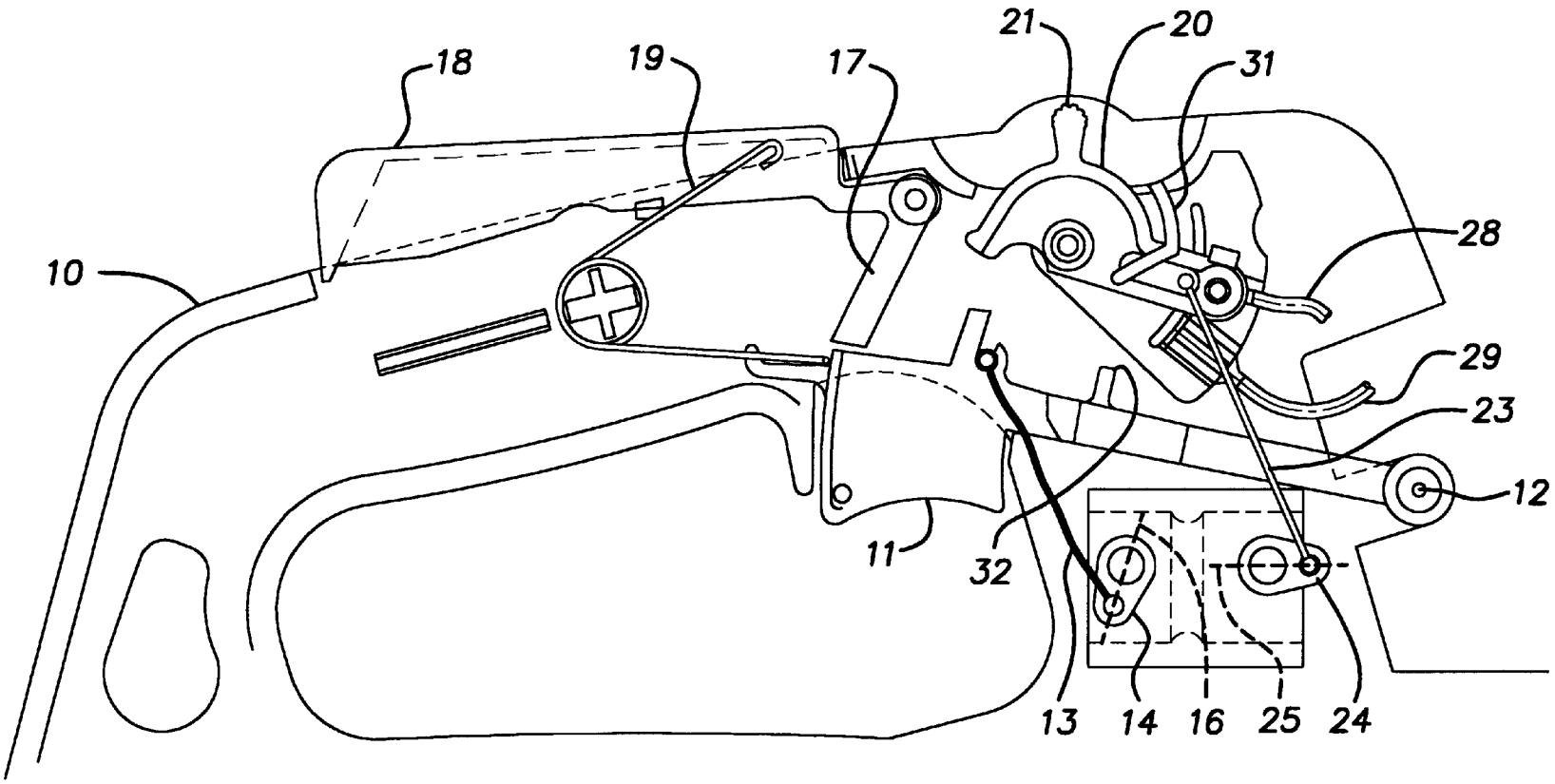
FIG. 3 is a corresponding view of the carburetor control in an idling position.
Figure 4:
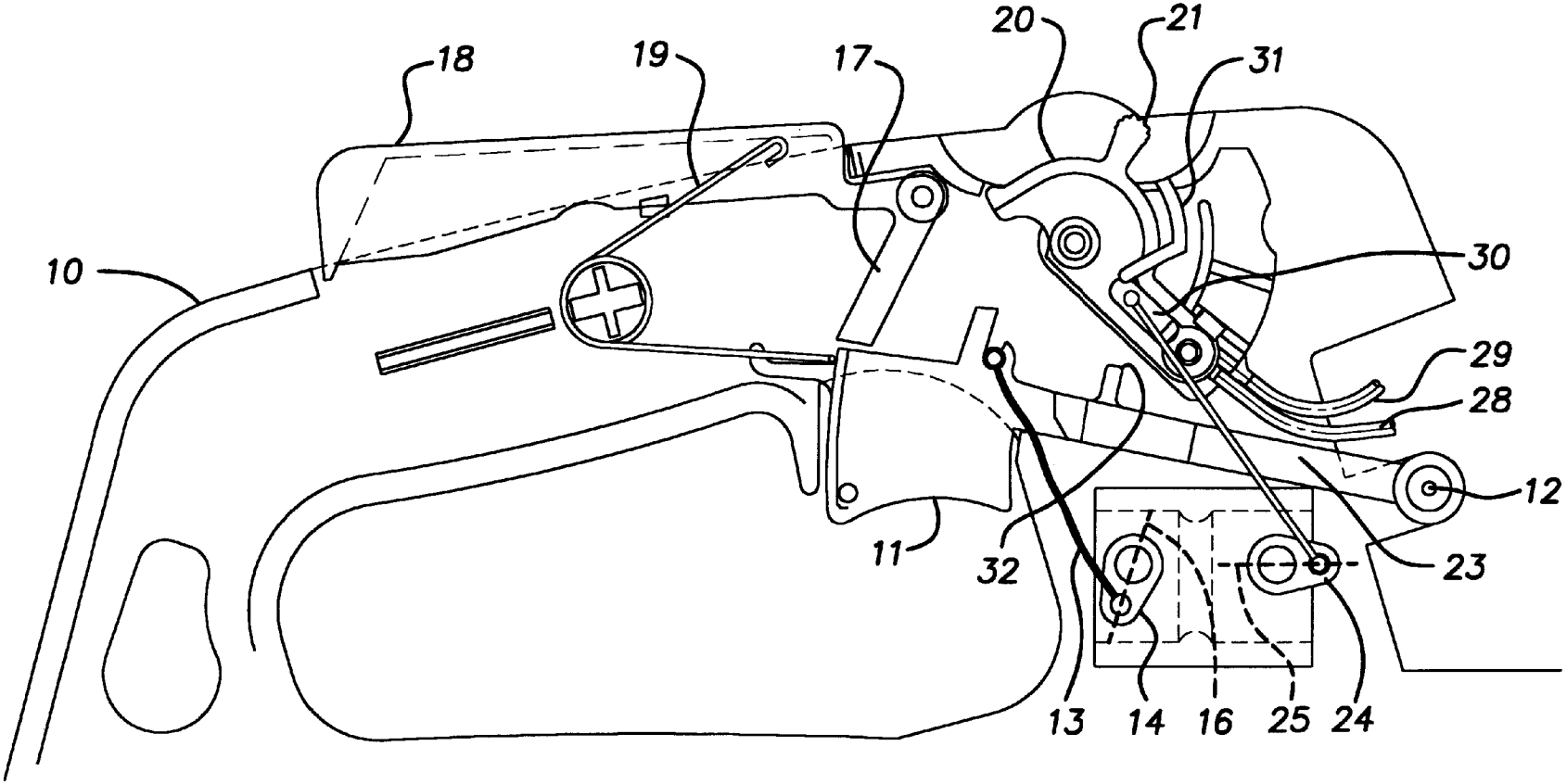
FIG. 4 is a corresponding view of the carburetor control in a stop position.

FIG. 3 shows an idling position of the engine. From this position the start control 20 can be adjusted to a shut-off position shown in FIG. 4. In this position contact is established between two short-circuit conduits 28 and 29 connected to the ignition system, whereby the ignition current is broken and the engine stops. The adjustment of the start control to the shut-off position is made possible in that the upper end of the bar 23 is slidably attached to a slot 30 of the start control. During adjustment from a starting to an operating position sliding of the upper end of the bar in the slot is prevented by a guide wall 31 in the housing. During further adjustment to the shut-off position such sliding is no longer prevented, as shown in FIG. 4, and adjustment can thus take place without being obstructed by the bar 23 and the choke lever 24.

In order to prevent adjustment of the start control 20 to the stop position when the gas throttle is open, a second stop 32 is provided on the gas control 11. As can be seen in FIG. 2, the stop 32 engages the start control 20 in the operating position, and it is thus not possible to stop the engine by the start control without releasing the gas control to close the throttle. Breaking the ignition current when the engine is running at full speed would cause unburnt fuel to pass through the engine which is inappropriate with regard to the environment. Also, if the engine has a catalyst exhaust gas purifyer, a flame might occur which is dangerous to the operator and the environment.

As should be apparent from the above description, the carburetor control is adjustable between start, operating, and stop positions by means of one and the same control lever 21. In addition, incorrect actuation of the carburetor, that might jeopardize the function of the exhaust purifying system, for example, is prevented.

We claim:

1. Carburetor control for a carburetor of an internal combustion engine, in particular for a motor saw, said carburetor having a gas throttle (16) and a starting means (25), said carburetor control comprising a gas control (11) connected to said gas throttle, and a start control (20) connected to said starting means and adjustable between a starting position and an operating position, wherein the gas control (11) has a first stop (26) adapted to engage a corresponding stop (27) on said start control (20) in order to positively adjust said starting means (25) to the operating position when said gas throttle (16) is opened, and wherein said start control (20) is adjustable to a stop position in which an ignition current to the engine is broken.

2. Carburetor control according to claim 1, wherein the start control (20) is connected to the starting means (25) by a bar (23) which is slidably connected to a slot (30) in said start control, whereby the start control is adjustable to the stop position without actuating the starting means (25).

3. Carburetor control according to claim 2, wherein the gas control (11) has a second stop (32) cooperating with the start control (20) in order to prevent adjustment of said start control to the stop position when the gas throttle (16) is open.

4. Carburetor control for a carburetor of an internal combustion engine, in particular for a motor saw, said carburetor having a gas throttle (16) and a starting means (25), said carburetor control comprising a gas control (11) connected to said gas throttle, and a start control (20) connected to said starting means and adjustable between a starting position and an operating position, wherein the gas control (11) has a first stop (26) adapted to engage a corresponding stop (27) on said start control (20) in order to positively adjust said starting means (25) to the operating position when said gas throttle (16) is opened, and wherein the stop (27) of the start control (20) is adapted to cooperate with the gas control (11) in order to prevent adjustment of said start control to the starting position when the gas throttle (16) is open and the start control (20) is adjustable to a stop position in which an ignition current to the engine is broken.

5. Carburetor control according to claim 4, wherein the start control (20) is connected to the starting means (25) by a bar (23) which is slidably connected to a slot (30) in said start control, whereby the start control is adjustable to the stop position without actuating the starting means (25).

6. Carburetor control according to claim 5, wherein the gas control (11) has a second stop (32) cooperating with the start control (20) in order to prevent adjustment of said start control to the stop position when the gas throttle (16) is open.

* * * * *